US005244235A

United States Patent [19]

Helgeson

[11] Patent Number: 5,244,235

[45] Date of Patent: Sep. 14, 1993

[54] MACHINE READABLE DOCUMENT AND METHOD FOR FORMING SAME

[76] Inventor: James E. Helgeson, 1700 Kimberly Pl., High Point, N.C. 27265

[21] Appl. No.: 861,089

[22] Filed: Mar. 31, 1992

[51] Int. Cl.[5] ..... B42D 15/00

[52] U.S. Cl. ..... 283/116; 283/58; 283/70; 283/904

[58] Field of Search ..... 283/97, 58, 70, 904, 283/116

[56] References Cited

U.S. PATENT DOCUMENTS

| | | | |
|---|---|---|---|
| 3,671,059 | 6/1972 | Zeller | 283/57 X |
| 3,980,323 | 9/1976 | Boyreau | 283/58 X |
| 4,358,017 | 11/1982 | Erikson | 209/584 |
| 4,582,345 | 4/1986 | Kehoe | 283/70 |
| 4,588,211 | 5/1986 | Greene | 283/70 |
| 4,593,936 | 6/1986 | Opel | 283/904 X |
| 4,793,810 | 12/1988 | Beasley, Jr. | 434/165 |

*Primary Examiner*—Paul A. Bell
*Attorney, Agent, or Firm*—Shefte, Pinckney & Sawyer

[57] ABSTRACT

An article is disclosed for displaying a machine readable character having a predetermined location for receiving a manually marked character and an indicia which is not machine readable formed at the predetermined location. The indicia is formed in a guide pattern capable of being selectively traced manually with a machine recognizable marking material in a plurality of differing traced conformations over respectively differing portions of the guide pattern for selectively producing a corresponding plurality of differing machine readable characters. The guide pattern of the indicia may be arranged for selective formation of the traced conformations in the form of differing numerals or letters.

10 Claims, 3 Drawing Sheets

MACHINE READABLE DOCUMENT AND METHOD FOR FORMING SAME

FIELD OF THE INVENTION

This invention relates to documents intended to receive hand printed information such as negotiable instruments, commercial paper, checks, packages, envelopes and the like and, more particularly, to making the hand printed information on these documents machine readable.

BACKGROUND OF THE INVENTION

Many types of common everyday documents are routinely processed by classifying and sorting the documents according to information appearing thereon. By way of example, checks and similar drafts and negotiable instruments drawn upon a bank or like financial institution are routinely processed according to an account number assigned to the maker and according to the amount of the instrument. Similarly, the U.S. Postal Service processes mail on the basis of a geographical zip code system by which each item of mail is routed to its particular destination according to a zip code contained in the address on the face of the mail item.

While bank checks and similar instruments commonly carry the maker's account number printed thereon in machine readable form and a small proportion of mail is machine addressed with the zip code in a bar code or other machine readable form, much of the processing of checks, mail and similar documents must be performed manually, due in large part to the fact that a sizeable proportion of bank checks, mail and the like is written by the issuing party by hand.

This type of processing is very labor intensive as well as prone to significant numbers of errors. Others have recognized this problem and have proposed varying solutions, each of which is significantly flawed.

For example, Green U.S. Pat. No. 4,588,211 discloses a machine readable document such as a negotiable instrument or check 60 having a blank area or field 82 in which the check maker enters the numerical value of the check on line 86. The patent discloses a code means, such as the zones 116 to 124, comprised of normally invisible ink or coding which can be machine read. According to the particular sequence of coded or uncoded zones in each area of the check, such as, for example, the area 82, a machine can determine the particular location on the check where a given area is. However, there is still no guarantee that the handwritten information within each area can be machine readable because of the non-uniform nature of the characters represented in the area.

Another example of an attempt to solve the instant problem is the Kehoe U.S. Pat. No. 4,582,345 which discloses a check 10 having a "security device" 16 imprinted thereon for providing a numerical representation of the sum for which the check is drawn. The device 16 includes a plurality of rows 17, each containing an array of digits reading, from left to right, zero through nine. The check maker, when making out the check, writes in words the numerical amount of the check at the location 14 and then checkmarks, circles, crosses out, or otherwise scribes the appropriate digits in the row 17 of the security device 16 which correspond to the numerical amount of the check. However, Kehoe's proposed solution to the problem also falls short of its desired goal because of the difficulty in filling out the security device 16. Additionally, the security device 16 does not function with non-numerical information to be written on the check.

Yet another proposed attempt to enable certain documents to be machine read is found in Erikson U.S. Pat. No. 4,358,017 which discloses a mail direction system comprising an envelope 11 to be carried in a carrier 13 which may be, for example, a large envelope. On the upper right-hand corner of the front portion 15 of the carrier 13 is a clear plastic pocket 17 into which a director card 21 is inserted. The director card contains information concerning the location or address to which the carrier 13 is to be directed. The director card 21 has a plurality of indicia locations 25. The sender inscribes an indicia such as a numeral in each indicia location 25. To facilitate the printing of the indicia or numeral, each indicia location 25 has a "double dot" 27 which helps the writer properly center the indicia or numeral being inscribed in the indicia location 25. However, this method and device still does not ensure machine readable alphanumeric markings on documents.

Thus, it is desirable to provide a method and article resulting in a machine readable document which ensures fairly uniform alphanumeric hand printed indicia to facilitate machine reading of the handwritten indicia on the document.

SUMMARY OF THE INVENTION

It is therefore an object of the present invention to provide machine readable hand printed information on a document.

It is yet another object of the present invention to provide a novel machine readable document and process which minimizes the problems of recognizing handwritten information.

It is yet another object of the present invention to provide a novel machine readable document and process wherein variable data at a particular location on the document may be reliably machine read.

These and other objects of the present invention are accomplished with an article for displaying a machine readable character having a predetermined location for receiving a manually marked character and an indicia which is not machine readable formed at the predetermined location. The indicia is formed in a guide pattern capable of being selectively traced manually with a machine recognizable marking material in a plurality of differing traced conformations over respectively differing portions of the guide pattern for selectively producing a corresponding plurality of differing machine readable characters. The guide pattern of the indicia may be arranged for selective formation of the traced conformations in the form of differing numerals or letters.

The guide pattern may comprise an array of marks which are not machine readable and may be formed of either dots or dashes. For example, the array may advantageously be formed in an LED style format.

The article may be a negotiable instrument such as a bank check having a planar surface with at least one predetermined location for receiving a manually marked character, and an indicia in the predetermined location which is not machine readable and is arranged in an LED or similar pattern for selective formation of the traced conformations in the form of differing machine readable numerals or letters.

The method for forming a machine readable hand printed character on an article may comprise the steps of providing an article having a predetermined location for a manually-marked character to be placed thereon. An indicia is then formed which is not machine readable at said predetermined location in a guide pattern capable of being selectively traced manually with a machine recognizable marking material in a plurality of differing traced conformations over respectively differing portions of the guide pattern for selectively producing a corresponding plurality of differing machine readable characters. The method may also comprise the step of providing an article having at least one predetermined location for a manually-marked alphanumeric character to be placed thereon. The method may also include the step of imprinting the article at the predetermined location with the indicia in the form of an array of marks which are not machine readable. The marks may be in the form of LED type array.

DETAILED DESCRIPTION OF THE INVENTION

Figure 1:
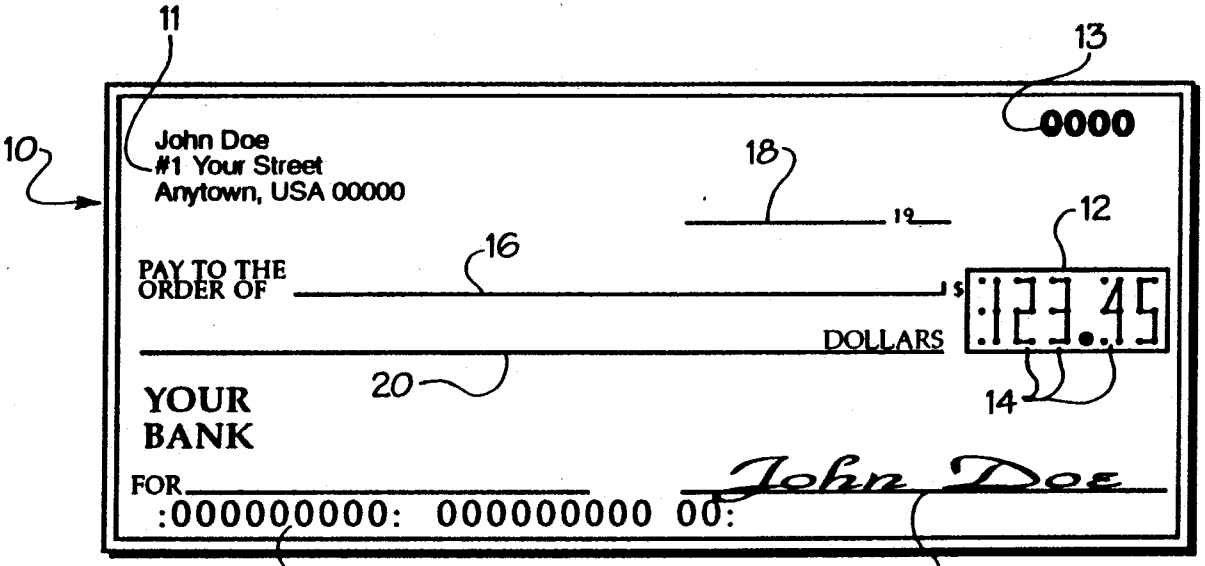
FIG. 1 shows a plan view of an article in the format of a check, according to the preferred embodiment of the present invention.

Referring now to FIG. 1, a documentary article 10 in the form of a common bank check is shown. As is typical, the check 10 is formed of a planar rectangular sheet of paper, the front surface of which is printed with the maker's address 11 in the upper lefthand corner of the document, a coded numerical indication of the particular bank and/or branch and the maker's particular checking account on which the check is drawn in the lower lefthand corner at 19, the number of the individual check 10 in sequential order in relation to other checks drawn by the same maker on the same account at 13 in the upper righthand corner of the check, a signature line 21 at the lower righthand corner of the check, and, lengthwise across the central area of the check 10, a payor line 16 for entry of the name of the party to whose order the check 10 is written, an amount line 20 for written entry of the check's particular amount, and a so-called convenience box 12 for numerical entry of the amount of the check in correspondence to the amount line 20.

As is well known, the numerical bank/account code 19 is conventionally printed in machine readable characters to facilitate partially automated processing of such bank checks. Likewise, the check number 13 may also be printed in machine readable characters or, alternatively, the bank/account number 19 may include a series of additional digits representing the check number. However, because checks are typically handwritten by the maker, it has heretofore been difficult or impossible for the automated equipment utilized by banks to process checks to also electronically read the convenience amount 12.

According to the present invention, this problem with conventional checks is solved by providing the convenience amount location 12 with a series of preprinted indicia 14 representing the appropriate locations of the digits of any numerical amount in which the check 10 is to be made. Each indicia 14 itself is not machine readable as printed but is formed in a guide pattern capable of being selectively traced manually by the check maker with an ink pen or other suitable machine recognizable marking material in a plurality of differing traced conformations over respectively differing portions of the guide pattern for selectively producing any of the ten numerals in the arabic system at each indicia location 14. Thus, by way of example, for a check in the amount of $123.45 the guide patterns of the series of indicia 14 are traced as shown in FIG. 1.

Figure 2:
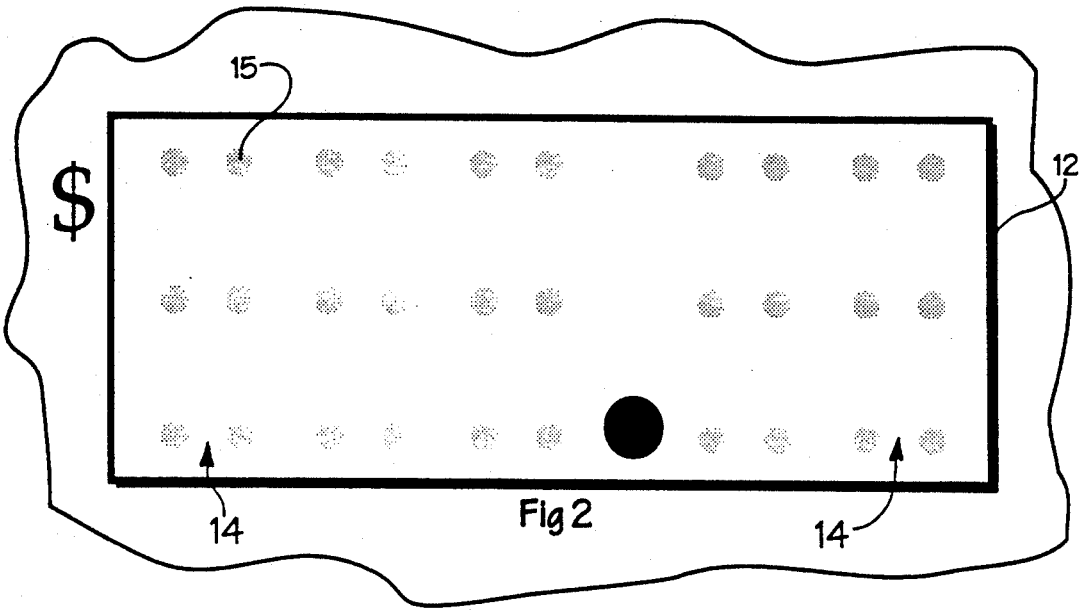
FIG. 2 is a substantially enlarged plan view showing the character-forming guide pattern of the check of FIG. 1, which comprises an array of dots
Figure 3:
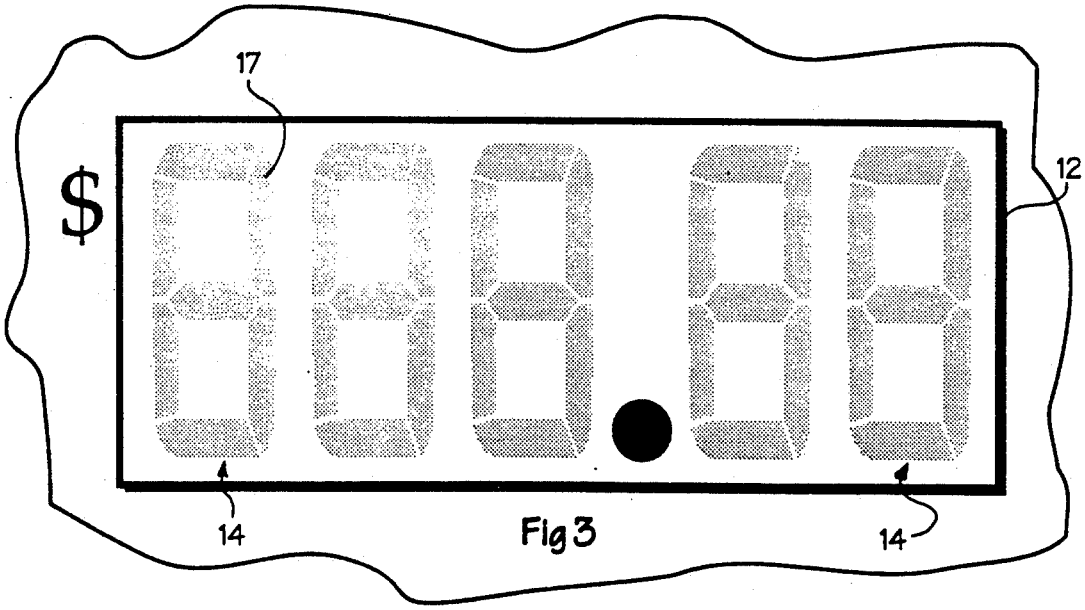
FIG. 3 is a similarly enlarged plan view showing an alternative guide pattern for the check of FIG. 1, which comprises an array of dashes in a common LED-format.
Figure 4:
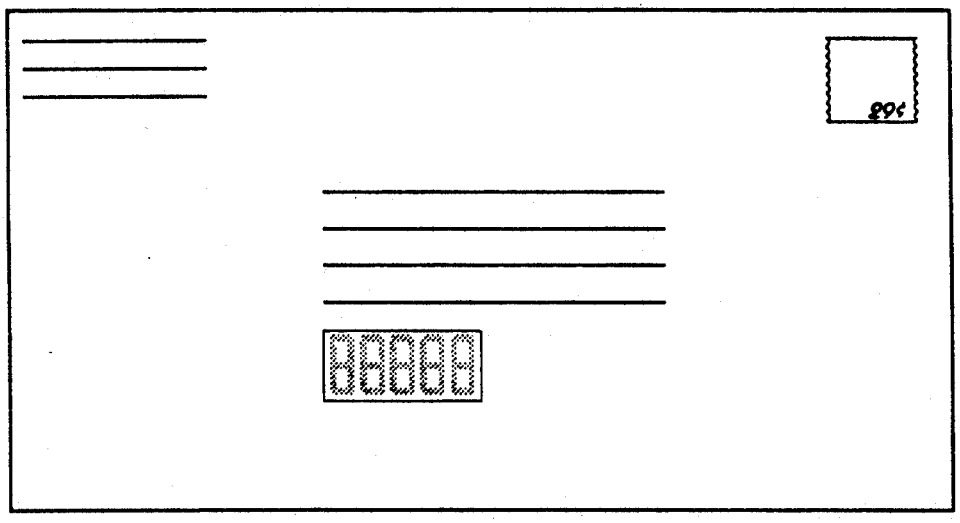
FIG. 4 shows a plan view of an article in the form of a mailing envelope, according to an alternative embodiment of the present invention.

The particular guide pattern for each of the series of indicia 14 in the check's convenience amount location 12 may be of a variety of differing forms. By way of example but without limitation, FIGS. 2 and 3 illustrate two possible alternative guide pattern formats for the indicia 14. FIG. 2 illustrates perhaps the simplest possible form for an indicia guide pattern in accordance with the present invention, the guide pattern for each indicia 14 being in the form of an array of six dots 15 in two spaced side-by-side columns of three dots each. As will be understood, this array of dots 15 enables the maker of the check 10 to mark the location of each indicia 14 to connect selected ones of the adjacent dots 15 with horizontal or vertical lines to form any selected one of the ten possible arabic numerals, as already representatively shown in FIG. 1.

Of course, as those persons skilled in the art will recognize, each indicia 14 could alternatively utilize dashes or other marks in the same or a different array relative to one another, so long as the arrangement of the marks provides a guide to the maker of the check 10 sufficient to enable the maker to trace, connect or otherwise follow the markings of the guide pattern in differing conformations to form differing numerals. FIG. 3 illustrates another such form of guide pattern comprising generally linear marks 17 formed in a generally figure-eight-like array corresponding to the conventional LED-format commonly employed by many conventional electronic digital displays, e.g., on conventional pocket calculators and the like. Other suitable forms of guide patterns for the indicia 14 may include more sophisticated dot-matrix patterns.

Of course, as those persons skilled in the art will readily recognize, the present invention is not limited to the formation of numerals in the convenience amount location of checks. Rather, the present invention contemplates the provision of any indicia in the form of a non-machine readable guide pattern at any predetermined location on virtually any document or article intended to be manually marked with at least one of a plurality of possible identifying characters, so that the indicia provides a means by which the manually marked character or characters can be machine read by the available technology incorporated in conventional automatic optical recognition equipment.

By way of additional example, the present invention contemplates that mailing envelopes, labels and the like can be pre-printed with a series of non-machine readable indicia intended for completion with a mailing zip code to enable hand-addressed envelopes and packages to be automatically machine-processed, as depicted in FIG. 2. It is also within the scope of the present invention to provide similar indicia with a guide pattern capable of being selectively traced to form letters rather than numerals or, alternatively or in addition, to form other possible machine-readable characters.

In any case, the markings forming the guide pattern of any particular indicia according to the present invention are preprinted so as not to be machine readable in themselves, for example, by printing the markings faintly or in a relatively light non-black color, so that indicia which is not traced and untraced marks of indicia which is partially traced are not recognizable to conventional automated processing equipment.

Advantageously, by use of the present invention, handwritten numerals, letters or other characters are formed of a consistent machine-readable shape and configuration making it possible for handwritten checks, mailing envelopes, packages, and the like to be read and handled by automated equipment, regardless of differences in handwriting from one person to another. In turn, banks, mail and package delivery services, and the like, are enabled to process and handle articles utilizing the present invention more rapidly and accurately and at less expense than the highly labor-intensive processing techniques conventionally in practice.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a bank check comprising a sheet of paper imprinted in a standardized form to be completed by a check maker with predetermined categories of information, said form including a predetermined location for numeric entry of a check amount, the improvement comprising a series of plural indicia permanently preprinted at said check amount location to represent respective positions for placement of individual numerals forming in combination the check amount, each said indicia comprising a marking permanently pre-printed to be visible to the check maker but not to be machine readable by automatic check processing equipment having electronic optical numerical-recognition means, each said marking forming a guide pattern capable of being selectively traced manually with a machine-recognizable marking material in a plurality of differing traced conformations over respectively differing portions of said guide pattern for selectively producing any one of a corresponding plurality of differing machine readable numerals, whereby the check maker is enabled to enter manually any desired check amount in a form which will be machine readable by automated check processing equipment having electronic optical numeral-recognition means.

2. The bank check of claim 1 wherein each said marking comprises an array of printed marks which are not machine readable collectively forming said guide pattern.

3. The bank check of claim 2 wherein said marks are dashes.

4. The bank check of claim 2 wherein said array of marks is arranged in an LED-style numeric format.

5. The bank check of claim 2 wherein said marks are dots.

6. In a mailing package comprising a writing surface imprinted in a standardized form to be completed by an addressor with predetermined categories of information, said form including a predetermined location for numeric entry of a postal code, the improvement comprising a series of plural indicia permanently pre-printed at said postal code location to represent respective positions for placement of individual numerals forming in combination the postal code, each said indicia comprising a marking permanently pre-printed to be visible to the addressor but not to be machine readable by automatic postal processing equipment having electronic optical numeral-recognition means, each said marking forming a guide pattern capable of being selectively traced manually with a machine-recognizable marking material in a plurality of differing traced conformations over respectively differing portions of said guide pattern for selectively producing any one of a corresponding plurality of differing machine readable numerals, whereby the addressor is enabled to enter manually any desired postal code in a form which will be machine readable by automated postal processing equipment having electronic optical numeral-recognition means.

7. The mailing package of claim 6 wherein each said marking comprises an array of printed marks which are not machine readable collectively forming said guide pattern.

8. The mailing package of claim 7 wherein said marks are dashes.

9. The mailing package of claim 7 wherein said array of marks is arranged in an LED-style numeric format.

10. The mailing package of claim 7 wherein said marks are dots.

* * * * *